US006761493B1

(12) United States Patent
Hooper et al.

(10) Patent No.: US 6,761,493 B1
(45) Date of Patent: Jul. 13, 2004

(54) PRINTING DEVICE CONFIGURED TO PRINT A DEMONSTRATION PAGE

(75) Inventors: Howard G. Hooper, Boise, ID (US); Eric Unger Eskey, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/683,211

(22) Filed: Oct. 10, 2003

Related U.S. Application Data

(63) Continuation of application No. 10/391,063, filed on Mar. 18, 2003, now Pat. No. 6,702,488.

(51) Int. Cl.[7] ..... B41J 3/00

(52) U.S. Cl. ..... 400/61; 400/70; 358/1.2; 710/65

(58) Field of Search ..... 400/61–63, 70, 400/76; 358/1.15–1.18, 1.1, 1.2, 1.9; 710/3–6, 65, 74

(56) References Cited

U.S. PATENT DOCUMENTS 5,075,875 A * 12/1991 Love et al. ..... 358/1.18
5,550,985 A * 8/1996 Miller et al. ..... 713/324
5,561,528 A * 10/1996 Johnson et al. ..... 358/296
5,847,693 A * 12/1998 Shima ..... 345/156
6,042,278 A * 3/2000 Spencer et al. ..... 400/61
6,549,962 B1 * 4/2003 Emmert et al. ..... 700/65
6,559,971 B1 * 5/2003 Watts et al. ..... 358/1.2

FOREIGN PATENT DOCUMENTS

JP 03264384 A * 11/1991 ..... B41J/29/46
JP 08183212 A * 7/1996 ..... B41J/13/00
JP 08282068 A * 10/1996 ..... B41J/29/46

* cited by examiner

*Primary Examiner*—Minh Chau

(57) ABSTRACT

An exemplary embodiment of the present invention provides for a printing device which is connectable to a computer. The printing device includes a user interface which includes a primary user interface button. When the printing device is not connected to the computer and the primary user interface button is actuated in an intended manner, the printing device prints a demonstration page. However, when the printing device is connected to the computer then the printing device is configured to detect the presence of the computer, and to perform a function defined within the computer when the primary user interface button is actuated in the intended manner.

17 Claims, 6 Drawing Sheets

PRINTING DEVICE CONFIGURED TO PRINT A DEMONSTRATION PAGE

CROSS REFERENCE TO RELATED APPLICATIONS

This application is a continuation application under 35 U.S.C. § 120 of U.S. patent application Ser. No. 10/391,063, filed Mar. 18, 2003 , now U.S. Pat. No. 6,702,488 which is hereby incorporated by reference herein in its entirety.

BACKGROUND

It is a common practice for a retail establishment that offers printing devices ("printers") for sale to have a demonstration model available for potential buyers to inspect. It is further desirable that potential buyers of such printers be able to observe the operation of the printers offered for sale. More particularly, it is desirable to allow the potential buyer, or a sales representative, to be able to print a page using the demonstration model so that that quality of an image produced by the printer, and the speed with which the image is generated, can be observed by the potential buyer. To this end, it is common to provided a demonstration model of a printer that can print a demonstration page (hereinafter, "demo-page") which includes graphics and/or text that give an indication of the imaging capabilities of the printer. It is further desirable to allow a potential customer, or a sales representative, to be able to quickly and easily print a demo-page. However, since most printers are configured to print under the control of a separate connected computer (such as a personal computer), this can require each demonstration printer which is to be capable of printing a demo-page to be connected to such a computer. Providing a separate computer for each demonstration printer can be costly, and requires a significant amount of space to accommodate the computers. While multiple demonstration printers can be connected to a single computer, this can require a complex networking system and custom software installed on the computer, and can also require that a user interact with the computer to print a demonstration page for any given demonstration printer connected to the computer. Requiring a user, or a sales representative, to interact with a computer in order to print a demo-page may discourage potential buyers from printing the demo page.

One solution is described in U.S. Pat. No. 6,042,278, which is assigned to the assignee of the present application. This patent describes a control unit to which a number of demonstration printers can be attached. The control unit is configured to receive a "print demo-page" signal from each of the demonstration computers and, in response thereto, to cause the respective demonstration printer to print a demo-page. This is an effective solution, and does not require any additional effort of the part of a potential buyer, or a sales representative, to print a demo-page using the demonstration printers connected to the control unit. However, this solution does require providing the control unit, with its concomitant cost, and installation and setting-up the control unit.

SUMMARY

One embodiment of the present invention provides for a printing device which is connectable to a computer. The printing device includes a user interface which includes a primary user interface button. When the printing device is not connected to the computer and the primary user interface button is actuated in an intended manner, the printing device prints a demonstration page. However, when the printing device is connected to the computer the printing device is configured to detect the presence of the computer, and to perform a function defined within the computer when the primary user interface button is actuated in the intended manner.

Another embodiment of the present invention provides for a method of controlling a printing device which is connectable to a computer. The printing device includes a primary user interface button. The method includes determining the generation of an input signal resulting from actuation of the primary user interface button in an intended manner, and determining whether or not the printing device is connected to the computer. In response to determining generation of the input signal and determining that the printing device is not connected to the computer; a demonstration page is printed by the printing device. However, in response to determining generation of the input signal and determining that the printing device is connected to the computer, a function defined within the computer is performed by the printing device.

These and other aspects and embodiments of the present invention will now be described in detail with reference to the accompanying drawings, wherein:

DETAILED DESCRIPTION

Figure 1:
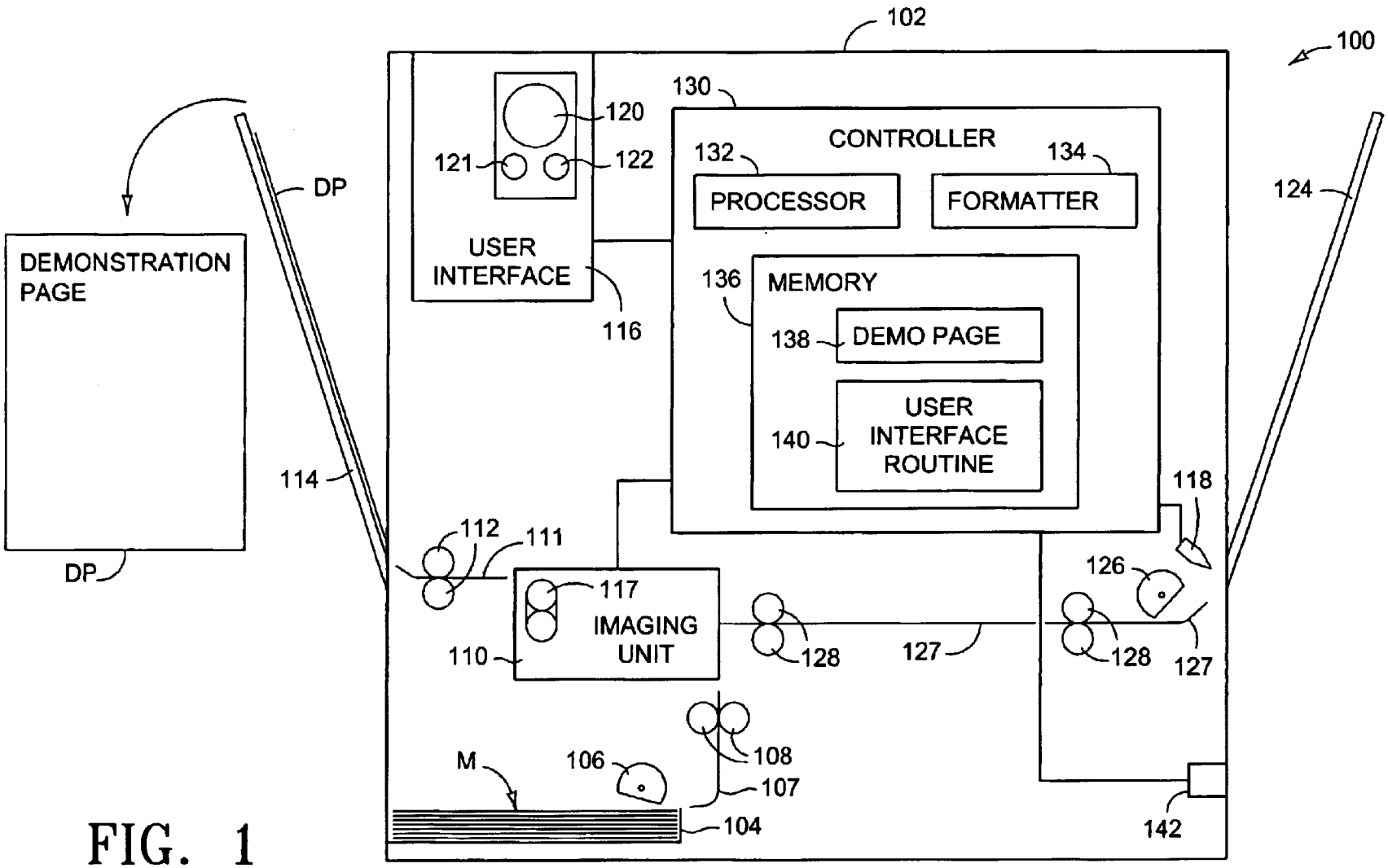
FIG. 1 is a side view depicting a printing device in accordance with one embodiment of the present invention.

As used herein, the expression "printing device" includes not only print-only printing devices (i.e., a printing device configured only to generate an image from an electronic file onto imaging sheet media (e.g., paper, transparencies, card stock, envelopes, labels, etc.)), but also photocopiers, facsimile devices, and so-called multi-function printing devices which include two or more of the above-mentioned capabilities (i.e., printing of an electronic file, generating a photocopy, and/or sending or receiving a facsimile). A printing device includes an imaging unit which is configured to generate an image on to imaging sheet medium. Common examples of an imaging unit include, without limitation, an electrophotographic imaging unit (such as a laser imaging unit), a wet-ink imaging unit (such as an inkjet imaging unit), and a thermographic imaging unit.

One solution to allowing a potential buyer of a printing device to generate a demo-page using a demonstration printer, which avoids the problems of the prior art, is to provide the demonstration printer with software to allow the demonstration printer to print a demo-page in a stand-alone configuration (i.e., not connected to a separate computer or a control unit such as is described in U.S. Pat. No. 6,042,278). While specific "demonstration printers" can be produced that have the capability of printing a demo-page in a stand-alone mode, this is an undesirable solution since it requires special manufacturing, and can result in a printing device (the demonstration model) that may not be saleable to the public. Further, should the demonstration model become inoperative for any reason, the retailer must then obtain a replacement demonstration model, rather than merely being able to place a saleable model in service as the demonstration model.

A number of modem printing devices include a user interface which consists of a single button. This configuration allows for simplification of manufacture of the printing device, as well as presenting the user with a non-complex user interface. In one example (available in the Hewlett-Packard 1100A printer, available from the Hewlett-Packard Company, Palo Alto, Calif.) the single button is a translucent plastic button having one or more light emitting diodes ("LEDs") placed beneath the translucent button. In one example, a green LED and an amber or red LED can be provided under the translucent button, such that selectively lighting of one or both of the LEDs can produce a color signal to a user via the translucent button, thus providing an additional level of information to the user. For example, lighting only the green LED can indicate a "ready" state of the printing device, while lighting only the amber (or red) LED can indicate an "error" situation which needs to be addressed by the user (e.g., a paper jam or the like). In the event of an "error" situation, intervention on the part of a user is typically required to address the circumstances causing the error signal (flashing amber LED, for example), after which the error signal is terminated. Further, one or more of the LEDs can be selectively pulsed under certain circumstances, thus providing a third level of information to the user. For example, a flashing green LED can indicate that the user is being prompted to provide special imaging media to the printing device.

In normal operation a user does not need to interact with the one-button user interface provided on certain printing devices. That is, typically a user will instruct a computer connected to the printing device to generate an image of an electronic file, and, in the absence of any special instructions or error conditions, the printing device will render the image on imaging media (such as paper, transparencies, etc.). However, in certain circumstances the user may wish to, or may be required to, interact with the one-button user interface. For example, as previously indicated, when custom imaging media is to be provided to the printing device, then the printing device can be configured to restrain printing of the electronic file until the user has indicated (by way of pressing the one-button user interface) that the custom media has been made available to the printing device. In another situation the user may wish to generate a configuration report (in the way of a printed "configuration page") describing the current configuration and status of the imaging device. A configuration page can include such information as: (1) the version of a printer driver installed on the computer connected to the printing device; (2) the computer port assigned to the printing device (e.g., "LPT1"); (3) a name assigned to the printing device by the user (e.g., "Laserjet Printer 1"), (4) the date the printing device was placed in service by the user; (5) the number of sheets imaged by the printing device since being placed in service; (6) the existence of any peripheral devices connected to the printing device (such as a copier unit); and/or (7) any other information relating to the capabilities and/or configuration of the printing device, the history of the printing device, and information relating to the association between the printing device and a connected computer. While a configuration page can be generated via a connected computer by accessing a software-based instruction within the computer to generate the configuration page, it is desirable to allow a user to generate a configuration page merely by pressing the single-button user interface a single time (or perhaps two times in rapid succession).

In addition to allowing a user to print configuration reports and notify the printing device when custom sheet media has been made available to the printing device (via a bypass tray, typically), a single-button user interface can also be configured, through user-interface software, to allow a user to perform other operations by selectively actuating the button in different manners. For example, the user-interface software can be configured such that when the single-button is pressed and held for a specific length of time (for example, five seconds or more) a fuser cleaning function is performed by the printing device, wherein the printing device runs a blank page of sheet media through the imaging device to clean a fuser in a laser-type electrophotographic printing device. In another example, if the single-button is pressed twice in rapid succession (with a time interval between the actuations of one second or less, for example), then a special report can be printed (e.g., parts ordering information, service information, etc.). While this differential selective operation of the single-button user interface can be documented in documentation provided with the printing device, it is desirable that the functionality be somewhat intuitive so that a user does not have to refer to the support documentation. Accordingly, the functionality that is likely to be accessed most frequently via the single-button user interface is made available by the simplest (and therefore, most intuitive) operation of the single-button (e.g., a single pulse of the button). Likewise, less frequently accessed functionality is made available by a more complex (and therefore, less intuitive) operation of the single-button user interface (e.g., a sustained pulse of the button, or two pulses of the button).

One embodiment of the present invention provides for a printing device having a single-button user interface that can enable a demo-page to be printed when the printing device is operating in a stand-alone mode, and can also enable a preferred functionality (e.g., printing a configuration report) to be performed when the printing device is operating in an installed mode (i.e., connected to a computer at a user site). It is desirable that both functions (i.e., printing the demo-page and performing the preferred functionality) be performed with the same intuitive selective operation of the single-button user interface (typically, a single pulse of the button). Accordingly, as will be described more fully below, one embodiment of the present invention provides for a printing device having a single-button user interface and user-interface software that allows a demo-page to be printed by single actuation of the button when the printing device is operating in a stand-alone mode, yet allows a different function to be performed by single actuation of the button when the printing device is operating in an installed mode. In this way a single printing device can operate both as a demonstration unit and as saleable product, depending on how the printing device is set-up (i.e., in stand-alone demonstration mode or in installed user-mode) such that a dedicated demonstration imaging device does not need to be provided in order to allow the printing device to operate in a stand-alone demonstration mode without being connected to a control unit or a separate computer.

While methods and apparatus described herein are particularly useful for printing devices having a single-button user interface, they are equally applicable to printing devices having multi-button user interfaces. Such multi-button user interfaces typically have a primary user interface button (labeled, for example, "Start"), and the primary user interface button is significantly differentiated from other buttons in the multi-button user interface, as for example by being larger than the other buttons, more prominently placed than the other buttons, and/or being a different color that the other buttons. Accordingly, as used herein, the expression "primary user interface button" includes the primary button in a multi-button user interface, as well as the single button in a single-button user interface. Further, the expression "primary user interface button" is intended to include not only "buttons" that are configured to be physically displaced (i.e., "pressed down", typically) when actuated, but also capacitance switches and other types of actuators which are not significantly physically moved from a first position to a second position (i.e., "pressed") during actuation.

As will be described further below, one embodiment of the present invention provides for a printing device which detects whether or not the printing device is connected to a computer (i.e., operating in an "installed mode" when connected to a computer). When the printing device is determined to not be connected to a computer, then it is assumed that the printing device is operating in a stand-along demonstration mode, such that actuation of the primary user interface button will cause a demo-page to be generated. However, when the printing device is determined to be connected to a computer, then it is assumed that the printing device is operating in an installed mode, such that actuation of the primary user interface button will cause a preferred function (typically, a function other than printing of a demo-page) to be performed. For example, the "preferred function" can be the generation of a configuration report. However, the preferred function can be printing a demo-page, such that actuation of the primary user interface button will cause a demo-page to be printed regardless of whether or not the printing device is connected to a computer.

In another embodiment a printing system includes a computer and a printing device connected to the computer. The printing device includes a primary user interface button. A printer driver for the printing device is installed on the computer, and allows a user to select between printing a demo-page or performing an alternative preferred function with a single actuation of the primary user interface button. In this way the printing device can be used as a demonstration printing device while connected to a computer, while still allowing a demo-page to be generated through an intuitive actuation of the primary user interface button.

Turning now to FIG. 1, a printing device 100 in accordance with a first embodiment of the present invention is depicted in a side elevation view. The printing device 100 is depicted in a simplified form to show only those components helpful for an understanding of this embodiment. The printing device 100 is connectable to a computer (such as computer 200 of FIG. 2) via a connector 142, and includes a housing 102 (FIG. 1) which houses the other components of the printing device. The printing device 100 includes an imaging unit 110 which is configured to form images on sheet media. The imaging unit 110 can be, for example, a laser imaging unit or an inkjet imaging unit. When the imaging unit 110 is a laser imaging unit, then it typically includes a fuser 117 which is used to fuse imaging media in the form of toner particles to the sheet media in order to form the desired image on the sheet media. The housing 102 supports a media tray 104 which in turn holds imaging media "M". A pick roller 106 can pick sheets of media "M" from the media tray 104 and feed them into a feed guide 107, at which point feed rollers 108 move the media into the imaging unit 110 for imaging. Sheet media exiting the imaging unit 110 is supported by output guide 111, and is moved by output rollers 112 into an output tray 114. A secondary media tray in the form of a bypass tray 124 can also be provided to allow a user to feed custom sheet media to the imaging unit 110. A bypass pick roller 126 is configured to pick sheet media (not shown) from the bypass tray 124 and move it into bypass media guide 127, whereupon bypass feed rollers 128 engage the custom sheet media and move it into the imaging unit 110. A media detector 118 can be provided at the base of the bypass tray 124 and can detect whether or not media has been placed in the bypass tray, or whether the media has been placed sufficiently far into the bypass tray 124 to allow the bypass pick roller 126 to engage the sheet media.

The printing device 100 further includes a user interface 116, which in turn includes a primary user interface button 120. The primary user interface button can be the only button in the user interface 116, or it can be one of a number of buttons in the user interface, in which case the primary user interface button 120 is typically more prominently displayed, as discussed above. In one example the primary user interface button 120 can be formed of translucent material, and one or more light sources, such as LEDs 121 and 122, can be placed under the translucent user interface button 120. In this way, by selectively illuminating the light sources 121 and 122, additional information can be provided to the user. For example, LED 121 can be a green LED, and LED 122 can be an amber or red LED. A condition in which no LED is illuminated can indicate that the printing device is in a "standby" mode, awaiting instructions. When the green LED 121 is continuously illuminated, this can indicate that the printing device is currently processing a printing task. When the green LED 121 is pulsed, this can indicate that the user needs to provide sheet media to the bypass tray 124. When the amber LED 122 is pulsed this can indicated that an error condition (for example, a paper jam or an empty media tray) exists within the printing device, thus requiring user intervention.

The printing device 110 further includes a controller 130, which in turn includes a processor ("printer processor") 132 and a computer readable memory device ("printer memory device") 136 which is in signal communication with, and readable by, the processor 132. The memory device 136 can include RAM and/or ROM memory components, and can be provided in the form of one or more semiconductor memory devices, as well as other forms of computer readable memory devices (e.g., a hard drive). Typically, the memory device 136 includes both RAM and ROM memory components (not specifically shown in FIG. 1). Contents stored in the ROM memory component of the memory device 136 can be provided by the manufacturer, and can include a formatter routine 134, a digital representation of a demonstration page ("demo-page") 138, and a user interface routine 140 (described more specifically below). In this way the printing device 100 can print the demo-page "DP" (from demo-page file 138) without having to access a demo-page file from a remote location (such as an external computer or controller). The RAM memory component of the memory device 136 can be used to receive digital information from a connected computer (computer 200 of FIG. 2, for example). The digital information from the computer 200 can include configuration instructions, but more commonly constitute a print-job (i.e., a digital representation of an image to be printed onto sheet media by the imaging unit 110). The print-job includes not only a digital representation of the image to be generated, but also instructions regarding formatting of the print-job (e.g., whether the image is to be generated in portrait or landscape format, whether standard media from the media tray 104 (FIG. 1) is to be used or whether custom media from the bypass tray 124 is to be used, etc.). The formatter 134 (FIG. 1) places the digital representation of the image to be generated into a raster image format which can then be transmitted to the imaging unit 110, under control of the printer processor 132, in order to cause the image to be printed onto sheet media.

The primary user interface button 120 is in signal communication with the printer controller 130. The primary user interface button 120 is configured such that when it is actuated (such as for example, by being pressed or touched), an input signal is generated which is transmitted to the processor 132. The input signal can vary depending on the manner in which the interface button 120 is actuated. For example, a single actuation of the interface button 120 (such as a relatively quick depress-and-release action) will generate a single pulse signal, whereas a sustained actuation of the interface button (such as a sustained press-and-hold of the button 120 for five or more seconds) will generate a series of essentially continuous pulses. Likewise, two relatively rapid actuations of the user interface button 120 will cause two separate input pulse signals, separated in time by the length of time between actuations of the button 120. As will be described more fully below, the user interface routine 140 can be configured to determine the manner in which the primary user interface button 120 has been actuated by a user, and cause the processor 132 to perform one or more selective functions depending on the input signal received from the user interface button 120. More specifically, the user interface routine 140 can include a series of computer-executable steps, executable by the processor 132, to determine whether or not the printing device 100 is connected to a computer (such as computer 200 of FIG. 2), to determine the type of input signal received from the primary user interface button 120, and to cause the processor 132 in turn to cause the printing device 100 to perform a specific function depending on the connectedness or non-connectedness of a computer and the type of input signal or signals generated by the primary user interface button 120. Typically, when the printing device 100 is determined to be connected to a computer, then the printing device will perform a function defined within the computer when the primary user interface button 120 is actuated. In the following discussion the expression "connected to the computer" refers not necessarily to a physical connection between the printing device 100 and a computer (e.g., computer 200 of FIG. 2), but rather to signal connectedness provided by a printer driver routine 208 (or the like) which is installed in the computer, thus allowing the printing device 100 to send information to the computer 200, and the computer to send data and instructions to the printing device.

Figure 2:
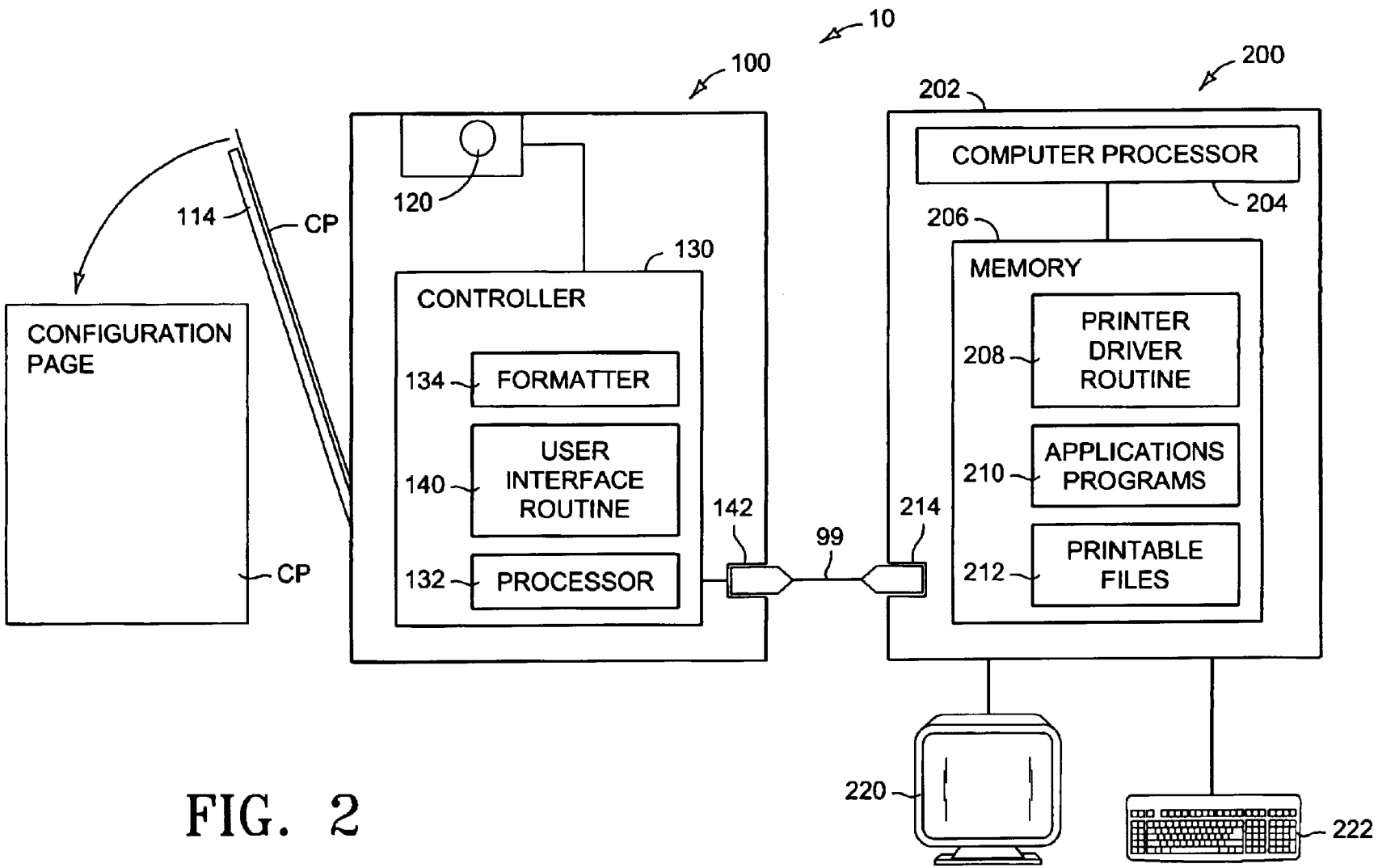
FIG. 2 is a side view depicting a printing system in accordance with a second embodiment of the present invention.

Generally, when the printing device 100 is not connected to a computer (i.e., the printing device is in the mode of a demonstration model at a retail sales location) and the primary user interface button 120 is actuated in an intended manner, the printing device 100 prints a demonstration page "DP" (demo-page file 138). However, when the printing device 100 is connected to a computer (as depicted in FIG. 2 wherein printing device 100 is connected to computer 200, corresponding to a typical user installation of the printing device) the printing device is configured to detect the presence of the computer, and to perform a function defined within the computer when the primary user interface button is actuated in the intended manner. The "intended manner" of actuation of the primary user interface button 120 will typically be selected to be the intuitive or most likely actuation of the primary user interface button 120 such that when the printing device is acting as a demonstration model, a potential purchaser can easily print a copy of the demo-page file 138. In the most common configuration, the intended manner of actuation of the primary user interface button 120 is a single pulsed actuation (i.e., a "press-and-release" actuation with a predetermined period of time specified within the user interface routine 140 between the "press" and the "release" to distinguish the "press-and-release" actuation over a "press-and-hold" actuation).

Figure 7:
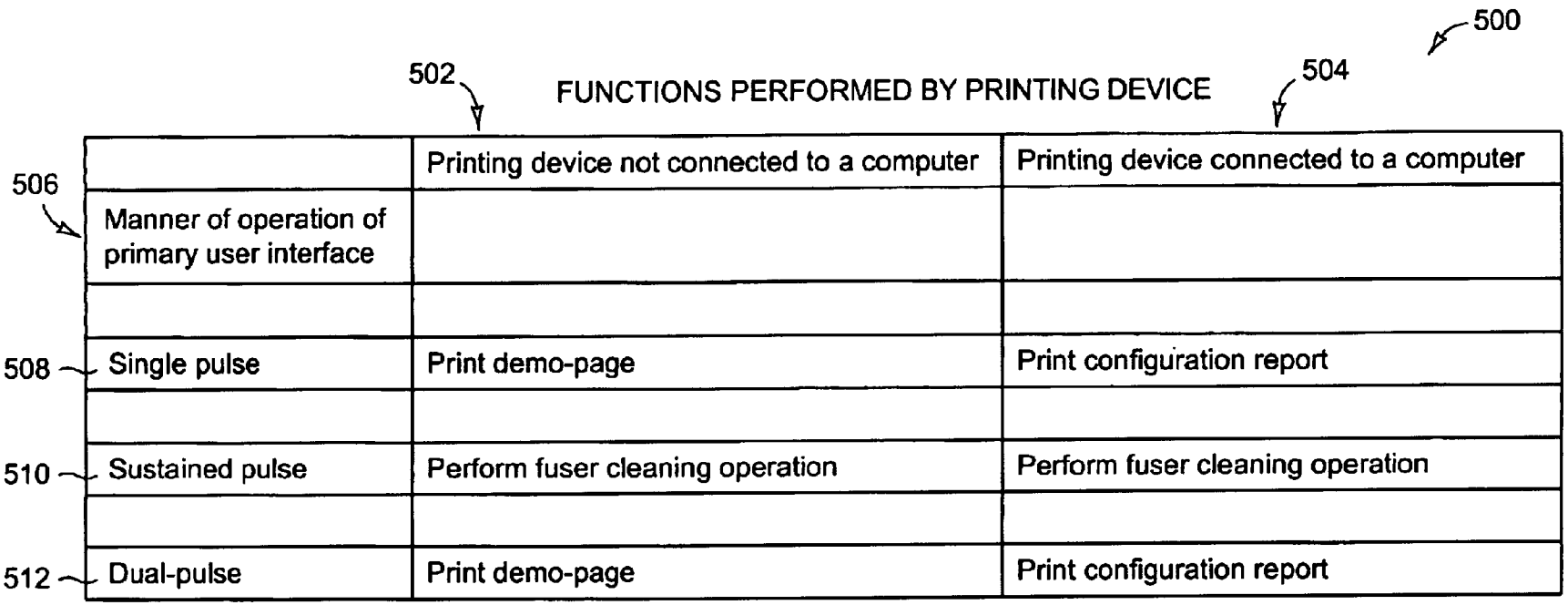
FIG. 7 is a chart depicting an exemplary schema for operation of a printing device in accordance with one embodiment of the present invention.

As indicated above, the user interface routine 140 can be configured to cause the printing device 100 to perform selected functions depending on the manner of actuation of the primary user interface button 120. This capability can be provided both when the printing device 100 is operating in a stand-alone (i.e., "demonstration") mode, and when the printing device is connected to a computer (as in FIG. 2, corresponding to a typical user-installed mode of the printing device 100). Accordingly, when the printing device 100 is operating in a stand-alone mode, actuation of the primary user interface button 120 in the intended manner (e.g., single pulsed actuation) will cause the demo-page file 138 to be printed, whereas actuation of the primary user interface button 120 in a second manner (different from the intended manner) will typically cause the printing device 100 to perform a function other than printing of the demonstration page file. For example, if the imaging unit is an electrophotographic laser imaging unit, then it will include the fuser 117. Under certain operating conditions the fuser 117 can become fouled with toner particles, thus having a deleterious effect on the quality of the image rendered on sheet media, in which case it is desirable to "clean" the fuser. "Cleaning" the fuser 117 typically involves passing a page of sheet media through the imaging unit 110 without generating an image onto the sheet media such that superfluous toner in the fuser 117 is transferred to the sheet media. Accordingly, operation of the primary user interface button 120 in the "second manner" (different from the "intended manner" which generates a demo-page) can be selected (within the user interface routine 140) to cause the printing device 110 to perform a cleaning operation on the fuser 117. For example, the "second manner" of operation can be holding the primary interface button 120 in an engaged position (i.e., "press-and-hold") for an extended period of time (for example, five seconds or more). A "press-and-hold" operation of the primary interface button 120 is typically a non-intuitive operation of the primary interface button 120, and therefore the fuser cleaning process will typically be performed by service personnel or a sales representative who understands that a fuser cleaning operation will be performed by the non-intuitive "press-and-hold" operation of the primary interface button 120. As indicate above, the user interface routine 140 can be configured to determine whether or not the printing device 100 is connected to a computer (such as computer 200 of FIG. 2), and the manner in which the primary interface button 120 is actuated. Thus, operation of the printing device 100 in response to actuation of the primary interface button 120 can be conditioned upon: (1) whether or not the printing device 100 is connected to a computer (such as computer 200 of FIG. 2); and (2) the manner in which the primary interface button 120 is actuated. Turning briefly to FIG. 7, a chart 500 depicts an exemplary schema for operation of a printing device (such as printing device 100 of FIG. 1) in accordance with an embodiment of the present invention. The chart 500 is divided into two columns 502 and 504. In the first column 502 the printing device (e.g., printing device 100 of FIGS. 1 and 2) is not connected to a computer (i.e., the printing device is operating in a "demonstration" mode), whereas in column 504 the printing device is connected to a computer (in which case the printing device is typically operating in a "user-installed" mode, but can also be operating in a "demonstration" mode). The chart 500 is further divided into three rows 508, 510 and 512, which correspond to the manner in which the primary user interface button (120, FIG. 1) is actuated, as indicated by column header 506. In the example depicted by the chart 500, when the printing device 100 (FIG. 1) is not connected to a computer, then a single pulse of the primary user interface button 120 (as indicated at row 508, column 502 of FIG. 7) will result in the printing device 100 (FIGS. 1 and 2) printing a demo-page. However, when the printing device 100 is connected to a computer (e.g., computer 200 of FIG. 2), then a single pulse of the primary interface button 120 (indicated at row 508, column 504 of FIG. 7) will result in the printing device 100 (FIGS. 1 and 2) printing a configuration report (described above). Further, a sustained pulse generated by the primary user interface button (120, FIG.1) as indicated at row 510 of FIG. 7 will result in a fuser cleaning operation being performed by the printing device 100 (FIG. 1), regardless of whether the printing device is connected to a computer or not. As also depicted in FIG. 7, a dual-pulse (row 512) of the primary user interface button (120, FIG. 1) can result in the demo-page being printed when the printing device 100 is not connected to a computer (FIG. 7, row 512, column 502), but results in a configuration page being printed when the printing device 100 (FIGS. 1 and 2) is connected to a computer (as indicated at row 512, column 504 of FIG. 7). It will be appreciated that the chart 500 of FIG. 7 is exemplary only, and that other schema for operation of the printing device 100 (FIG. 1) under the control of the user interface routine 140 can be provided.

Turning now to FIG. 2, a side elevation view of a printing system 10 in accordance with another embodiment of the present invention is depicted. The printing system 10 includes a printing device 100 (according to FIG. 1) in signal communication with a computer 200. Only selected components of the printing device 100 of FIG. 1 are shown in FIG. 2 for the purposes of simplification. As depicted in FIG. 2, the printing device 100 is in signal communication with the computer 200 via a connector cable 99 which connects to printing device connector 142 and computer connector 214. However, It will be appreciated that a connector cable 99 is not required for signal communication between the printing device 100 and the computer 200, and that other communication connections (such as infra-red or radio frequency connections) can be used. The computer 200 includes a computer housing 202 which supports a computer processor 204 and a computer memory device 206. The computer memory device 206 is readable by the computer processor 204, and can take the form of RAM and/or ROM memory devices, including semiconductor memory devices, one or more hard drives, and other magnetic and/or optical memory devices. The computer memory device 206 includes a printer driver program (or "printer driver routine") 208, applications programs 210 (as, for example, word processing and spreadsheet programs), and "printable files" 212 which can be generated by the applications programs 210 or which can be generated from a remote source in communication with the computer 200 (as, for example, from the Internet or a local area network). The printer driver program 208 includes a set of computer executable instructions which can be executed by the computer processor 204.

The computer 200 can further include a user display 220 (depicted here as being a display screen) and a user input interface (depicted here as being a keyboard 222), both of which are in signal communication with the computer processor 204. As described above, when the printing device 100 is not connected to the computer 200 (as depicted in FIG. 1) and the primary user interface button 120 is actuated in an intended manner (e.g., a single pulsed actuation), then the printing device 100 prints a demonstration page "DP", FIG. 1, from demo-page file 138. However, when the printing device 100 is connected to the computer 200 (FIG. 2), then the printing device 100 is configured to detect the presence of the computer 200, and to perform a function defined by the printer driver program 208 when the primary user interface button 120 of the printing device 100 is actuated in the intended manner. For example, and as depicted in FIG. 7, when the printing device 100 (FIG. 2) is not connected to the computer 200, then a single pulse actuation of the primary user interface button 120 will cause the printing device to print a demo-page (column 502, row 508 of FIG. 7), whereas when the printing device 100 (FIG. 2) is connected to the computer 200, then a single pulse actuation of the primary user interface button 120 will cause the printing device to print a configuration report (column 504, row 508 of FIG. 7).

In one variation, the printer driver program 208 (FIG. 2) is configurable by a user to allow the function defined by the printer driver program (i.e., the function performed by the printing device 100 when the primary user interface button 120 is actuated in the intended manner and the printing device is connected to the computer) to be selectable. That is, a user can select, within the printer driver program 208, a function to be performed by the printing device 100 when the primary user interface button 120 is actuated in the intended manner and the printing device is connected to the computer 200. For example, the printer drive program 208 can be configured to allow the demo-page file (138, FIG. 1) to be printed when the primary user interface button 120 is actuated in the intended manner, or alternatively, the printer driver program 208 can be configured to allow a configuration report "CP", (FIG. 2) to be printed when the primary user interface button 120 is actuated in the intended manner. This selectability within the printer driver program 208 allows the printing device 100 to be connected to a computer 200 yet still be used as a demonstration printer (thus providing for the printing of the demo-page "DP" of FIG. 1 when the primary user interface button 120 is actuated in the intended manner), or alternately, to designate that the printing device 100, as connected to the computer 200, is to be operated in a "user installed" mode (versus a "demonstration"mode), in which case actuation of the primary user interface button 120 in the intended manner will cause the printing device 100 to perform a function which is not necessarily printing of the demo page. That is, providing selectability within the printer driver program 208 allows for the printing device 100 to be connected to a computer and to alternatively be used in a demonstration mode or in a user-installed mode. Put another way, providing selectability within the printer driver program 208 allows a user to determine whether a demo-page will be printed, or some other function performed (e.g., printing of a configuration report) by the printing device 100 in response to the primary user interface button 120 being actuated in the intended manner when the printing device 100 is connected to a computer.

In one variation of the printing system 10 of FIG. 2, the computer 200 is configured to transmit to the printer formatter 134 (via connector 99) a data string (from "printable files" 212, for example) which constitutes a print-job. In this case the user interface routine 140 can be configured to be executable by the printer processor 132 to cause the printing device 100 to terminate active transmission of the data string to the formatter 134 when the primary user interface button 120 is actuated in the intended manner. That is, rather than allowing the function defined within the printer driver program 208 to be performed in response to the primary user interface button 120 being actuated in the intended manner (e.g., printing a configuration report), the user interface routine 140 instead cancels an active print-job.

Yet another embodiment of the present invention provides for a control system (e.g., controller 130 of FIG. 1) for controlling a printing device (such as printing device 100). As described previously, the printing device 100 includes a primary user interface button (e.g., button 120). The control system includes a processor (e.g., printer processor 132) which is configured to receive an input signal from the primary user interface button (e.g., button 120) resulting from actuation of the primary user interface button in an intended manner (such as a single pulsed actuation). The control system further includes a memory device (e.g., memory device 136) which is readable by the processor (132). The memory device (e.g., printer memory device 136) contains therein a set of computer executable instructions which can be executed by the processor (132). In FIG. 1, the set of computer executable instructions can be the user interface routine 140. The set of computer executable instructions (e.g., 140) are configured to: determine receipt of the input signal by the processor (132) resulting from actuation of the primary user interface 120; determine whether or not the printing device (100) is connected to a computer (e.g., computer 200 of FIG. 2); cause the printing device (100, FIG. 1) to print a demonstration page ("DP") in response to determining that the printing device (100) is not connected to the computer and that the input signal is received by the processor (132); and cause the printing device (100) to perform a function defined within the computer (200, FIG. 2) in response to determining that the printing device is connected to the computer and that the input signal is received by the processor (132).

As described previously, the function defined within the computer can be defined by a printer driver program 208 (FIG. 2). As also previously described, more than one function be can performed by selective actuation of the primary user interface button 120. That is, actuation of the primary user interface button 120 in the primary or intended manner (e.g., a single pulsed actuation) generates a first type of input signal intended to cause a first function to be performed (e.g., printing a demo-page if the printing device 100 is not connected to a computer, but printing a configuration report if the printing device is connected to a computer), and actuation of the primary user interface button 120 in a secondary manner (e.g., a push-and-hold manner, or a double-pulse manner) generates a second type of input signal intended to cause a second function to be performed. As with the "first function", the "second function" can be variable depending on whether or not the printing device is connected to a computer. Accordingly, the printer processor 132 can be configured to receive the second (type of) input signal from the primary user interface button 120, and the set of computer executable instructions ("user interface routine" 140) can be further configured to determine whether the processor (132) has received the second input signal, and to cause the printing device (100) to perform the second function in response to determining that the processor has received the second input signal. For example, the second function can be causing the printing device 100 to perform a fuser cleaning process, which can be carried out regardless of whether or not the printing device is connected to the computer (see for example row 510 of the function chart 500 of FIG. 7). In another example the second function can be printing the demo page "DP" (FIG. 1) when the printing device 100 is not connected to the computer (200, FIG. 2), and printing a configuration page "CP" when the printing device 100 is connected to the computer 200. In this latter example it can be seen when the printing device 100 is not connected to the computer 200, the demo-page is printed regardless of whether the user interface button is actuated in the first or second manner (see for example row 510 of the function chart 500 of FIG. 7).

As described previously, the printing device 100 (FIG. 2) is typically configured to receive data from the computer 200 in the way of a print-job. Accordingly, the set of computer executable instructions (i.e., the user interface routine 140) can be further configured to determine whether the printing device 100 is receiving data from the computer 200 in the way of a print-job, and to cancel the print-job in response to determining that the printing device 100 is receiving the print-job and that the input signal (generated by actuation of the primary user interface in the intended manner) is received by the processor 132.

Figure 3:
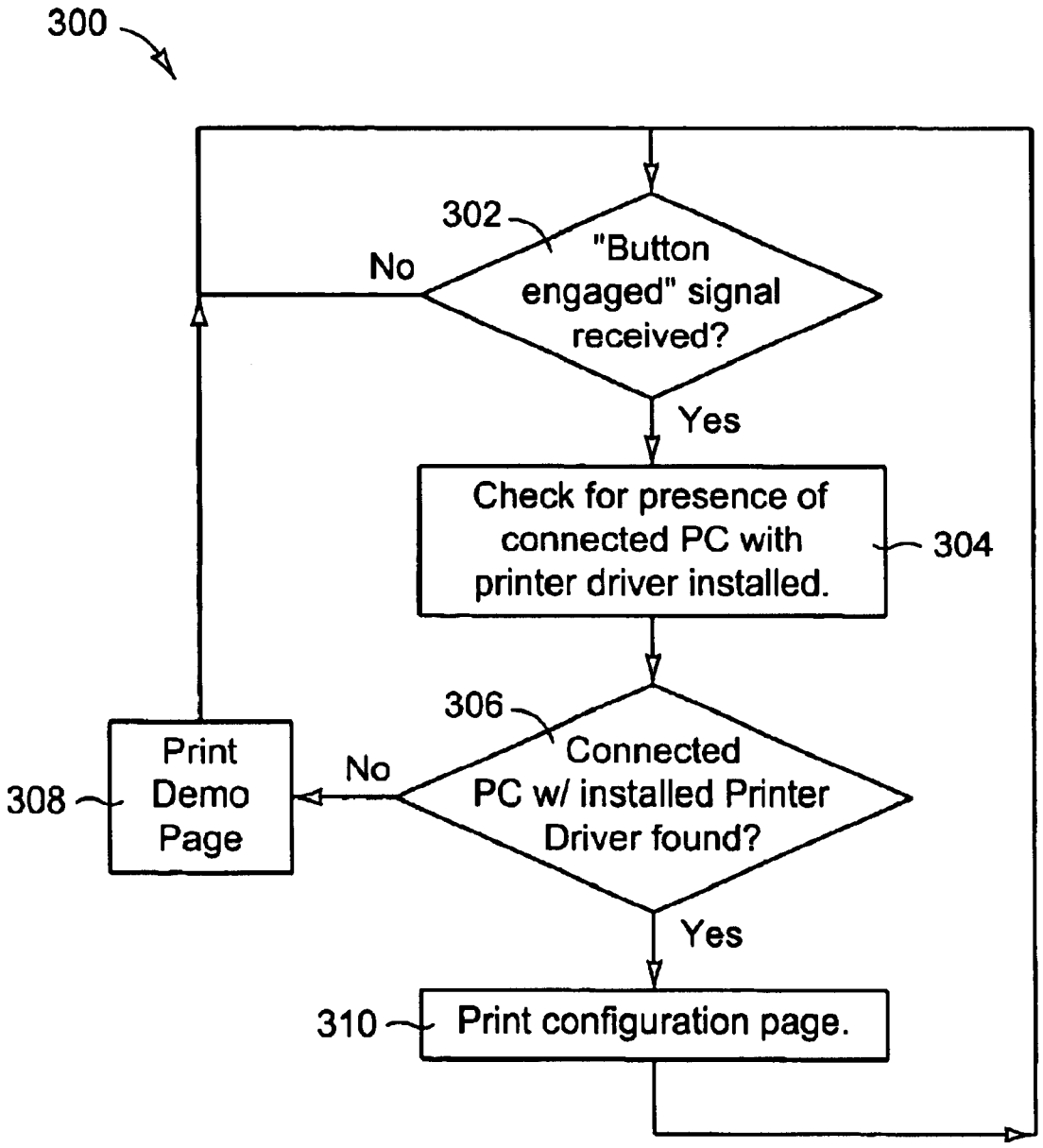
FIG. 3 is a flowchart depicting a method of printing a demonstration page, in accordance with another embodiment of the present invention.

Turning now to FIG. 3, a simplified flowchart 300 depicts steps that can be stored in the user interface routine 140 (FIG. 1) and executed by the processor 132 to implement a method in accordance with an embodiment of the present invention. At step 302 it is determined whether the processor 132 has received a "button engaged" signal from the primary user interface 120. If no such signal has been received, then the processor resumes monitoring at step 302 for the presence of the signal. However, if a "button engaged" input signal has been received, then at step 304 the processor 132 checks for the presence of a connected computer (e.g., computer 200 of FIG. 3), and the presence of an installed printer driver routine 208 in the computer. (In the flowchart 300 the acronym "PC" is used to stand for "personal computer", or, more generally, "computer".) If, at step 306, no connected computer with an installed printer driver program is found, then at step 308 the printing device 100 (FIG. 1) prints a demonstration page "DP". However, if at step 306 (FIG. 3) a connected computer with an installed printer driver program is found, then at step 310 the printing device prints a configuration report ("CP", FIG. 2). Following either step 308 or 310 (FIG. 3) control returns to step 302 to again monitor for a "button engaged" signal. It will be appreciated that step 310 can be a function other than printing a configuration report, and can also include printing a demo-page (such that a demo-page is printed regardless of the connectedness of the printing device 100, FIG. 1).

Figure 4:
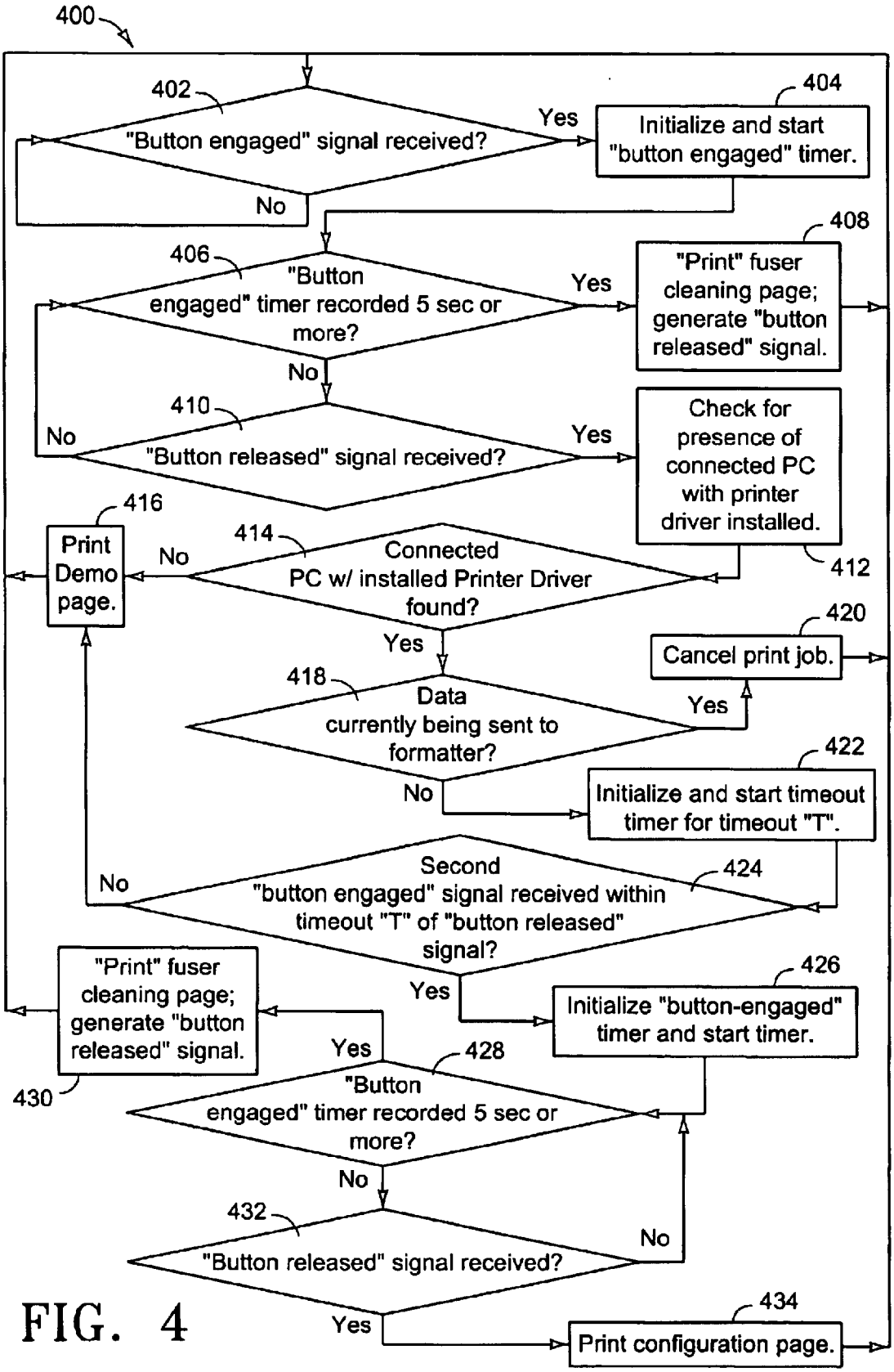
FIG. 4 is a flowchart depicting another method of printing a demonstration page in accordance with a further embodiment of the present invention.

Turning now to FIG. 4, a flowchart 400 depicts one example of how a user interface routine (140, FIGS. 1 and 2) can be configured to not only provide the functionality depicted in the flowchart 300 of FIG. 3, but additional functionality as well. More specifically, the flowchart 400 of FIG. 4 allows the processor 132 (FIG. 1) to make a number of different determinations (connectedness or non-connectedness of a computer, the manner in which the user interface button 120 is actuated, and whether or not the printing device 100 is currently receiving a print-job from a computer (200, FIG. 2). Based on the determinations made, a number of different functions can be provided by the printer processor 132.

Flowchart 400 (FIG. 4) begins at step 402, where a determination is made whether or not the processor 132 (FIG. 1) has received a "button engaged" signal from the primary user interface 120. If no such signal has been received, then the processor resumes monitoring at step 402 (FIG. 4) for the presence of the signal. However, if a "button engaged" input signal has been received, then at step 404 the processor initializes and starts a "button-engaged timer", which can be operated by the processor (132, FIG. 1) and stored in the memory device 136. At step 406 (FIG. 4) the processor (132, FIG. 1) checks the "button-engaged" timer to determine whether the user interface button (120, FIG. 1) has been engaged for a predetermined period of time (here, five seconds) or longer. If so, then at step 408 (FIG. 4) a fuser cleaning page is generated by the processor (132, FIG. 1) to cause the fuser 117 to be cleaned, after which control returns to step 402 (FIG. 4). However, if at step 406 it is determined that the "button-engaged" timer has not recorded a time of five seconds or more, then at step 410 a check is made to determine whether or not the processor (132, FIG. 1) has received a "button released" signal, corresponding to a user releasing the primary user interface button (120, FIG. 1) after having engaged the button. If no "button released" signal has been received, then the processor checks again at step 406 to determine whether the "button-engaged" timer has exceeded the preset limit (five seconds). However, if at step 410 a "button released" signal has been received, then at step 412 the processor checks for the presence of a computer ("PC") that is connected to the printing device (100, FIGS. 1 and 2) and which includes an installed printer driver program. For example, computer 200 of FIG. 2 is "connected" to the printing device 100 by virtue of (1) the connecting cable 99, and (2) the installed printer driver routine 208. If, at step 414 (FIG. 4) no "connected" computer is found, then at step 416 a demonstration page (e.g., demo-page "DP" of FIG. 1) is printed by the printing device 100, and control returns to step 402 (FIG. 4).

As can be seen, steps 402 through 410 of the flowchart 400 cause a fuser cleaning operation to be performed if the primary user interface button (120, FIG. 1) is pressed and held for five seconds or more, regardless of whether the printing device 100 is connected to a computer or not. Likewise, if the printing device 100 is not connected to a computer, then a demo-page is printed (step 416, FIG. 4) regardless of how many times the primary user interface button (120, FIG. 1) is actuated.

If at step 414 (FIG. 4) it is determined that the printing device is "connected" to a computer (as depicted in FIG. 2 wherein the printing device 100 is connected to the computer 200), then at step 418 (FIG. 4) a check is made to determine whether data is currently being sent from the computer (200, FIG. 2) to the printing device formatter 134, thus indicating that a print-job is being transmitted to the printing device 100. If so, at step 420 (FIG. 4) the print-job is cancelled, and control returns to step 402. However, if at step 418 it is determined that a print-job is not being currently sent to the printing device (100, FIG. 2) then at step 422 (FIG. 4) a "timeout" timer is initialized and activated. The tmeout timer is used to determine whether a second actuation of the user interface button (120, FIG. 2) has been performed within a set period of time (i.e., within the timeout period "T") to thereby allow the processor (132, FIG. 1) to determine if a two-pulse actuation of the button (120) has been performed, or whether two single pulse actuations have been performed. The timeout period "T" can be, for example, one second. The timeout timer can be operated by the printer processor 132 (FIG. 2) and stored in the printer memory device 136. At step 424 (FIG. 4) a check is made to determine whether a second "button engaged" signal has been received before expiration of the timeout period "T". If no such second signal is received within the timeout period "T", then the processor (132, FIG. 2) determines that a single actuation of the primary user interface button 120 has been performed, and proceeds with the task associated with a single pulsed actuation. In this example, the activity associated with a single pulsed actuation of the primary user interface button 120 when the printing device 100 is connected to a computer 200 (FIG. 2) is the printing of a demo-page at step 416 (FIG. 4). Thus, in the example depicted in FIG. 4, a single actuation of the primary user interface button 120 (FIG. 1) will cause a demo-page to be generated regardless of whether the printing device 100 is connected to a computer or not. However, it will be appreciated that a function other than printing of a demo-page can be performed in this instance. For example, in row 508 of chart 500 (FIG. 7) a single pulsed actuation of the user interface button 120 (FIG. 2) when the printing device 100 is connected to a computer 200 will cause the printing device to print a configuration report ("CP", FIG. 2).

Returning to FIG. 4, if at step 424 a second "button engaged" signal has been received by the processor 132 (FIG. 2) prior to the expiration of the timeout interval "T", then the processor determines that a two-pulse actuation of the primary user interface button 120 has been performed, and proceeds to step 426 (FIG. 4). At step 426 the "button engaged" timer of step 404 is again initialized and started. At step 428 a determination is made whether the "button engaged" timer has been recording for five seconds or more. If so, at step 430 a fuser cleaning operation is performed, a "button released" signal is generated, and control returns to step 402. However, if the "button engaged" timer has not yet expired, then at step 432 a determination is made whether a "button released" signal has been received. If not, control returns to step 428 to again check to determine whether the "button engaged" timer has expired. That is, steps 424 through 432 are based on the assumption that when a user provides a single pulsed actuation of the primary user interface button 120 (FIG. 1) followed by a sustained actuation of the interface button, the user intended to perform the fuser cleaning operation, and accidentally pressed and released the button a single time before pressing and holding the button. However, if at step 432 (FIG. 4) the "button released" signal is determined to have been received, then at step 434 the processor (132, FIG. 2) performs the task associated with a double-pulse actuation of the primary user interface button 120, which is here the printing of a configuration page or report ("CP", FIG. 2), after which control returns to step 402.

Figure 5:
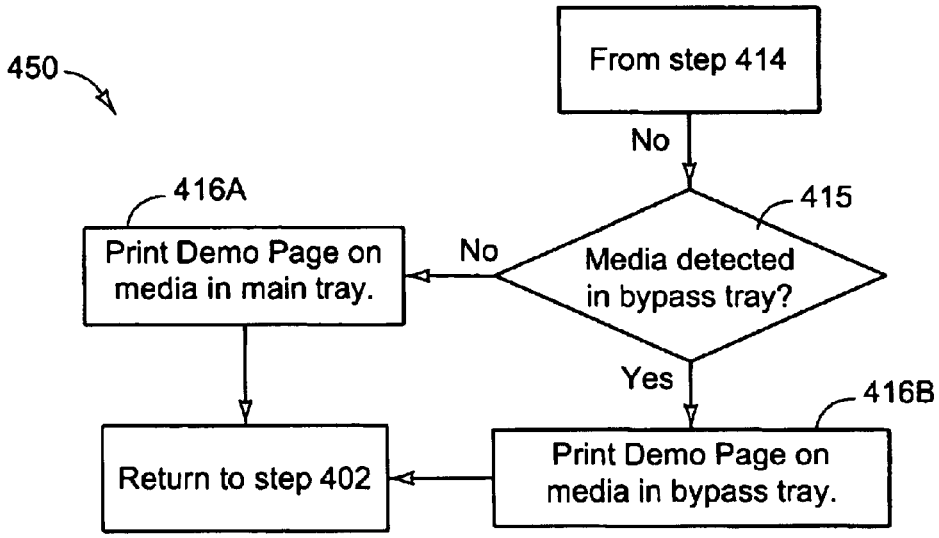
FIG. 5 is a flowchart depicting additional steps that can be added to the flowchart of FIG. 4.

It will be appreciated that the flowchart 400 of FIG. 4 is exemplary only to show one manner in which a user interface control routine (140, FIGS. 1 and 2) can be configured to allow a demo-page to be printed by a printing device (100). The flowchart 400 of FIG. 4 can be arranged differently, and can include fewer, additional or different steps. For example, turning to FIG. 5, a flowchart 450 depicts additional steps that can be added to the flowchart 400 of FIG. 4 following step 414 when it has been determined that the printing device (100, FIG. 1) is not connected to a computer. Flowchart 450 (FIG. 5) is based on the availability of a bypass media tray (124, FIG. 1). At step 415

(FIG. 5) a determination is made by the processor (132, FIG. 1) whether or not sheet media has been placed in the bypass tray 124. This can be accomplished by using the bypass media detector 118, for example. If at step 415 (FIG. 5) media is not detected in the bypass tray 124 (FIG. 1), then at step 416A (FIG. 5) the demo-page is printed on the media in the main media tray (104, FIG. 1) and control then returns to step 402. However, if at step 415 (FIG. 5) media is detected in the bypass tray 124 (FIG. 1), then at step 416B (FIG. 5) the demo-page is printed on the media in the bypass tray, after which control returns to step 402. In this instance, steps 416A and 4168 of FIG. 5 replace step 416 of FIG. 4.

Figure 6:
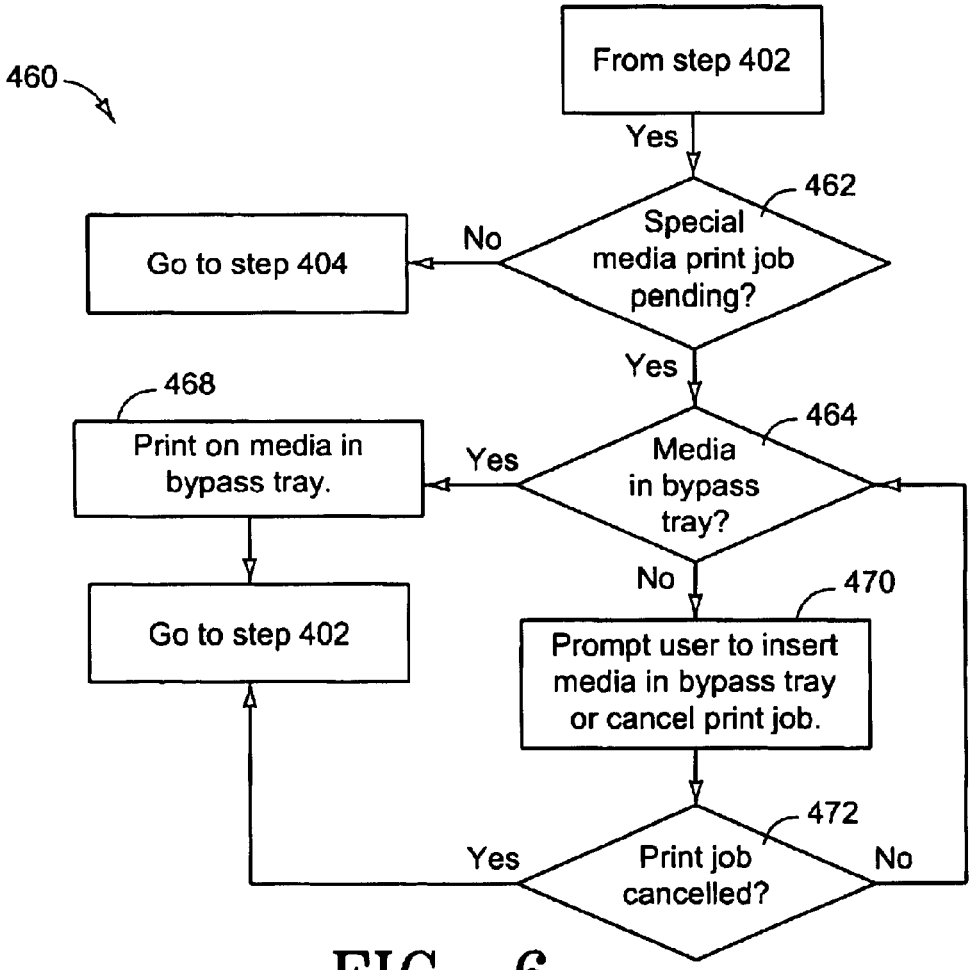
FIG. 6 is a flowchart depicting other additional steps that can be added to the flowchart of FIG. 4.

Another variation to the flowchart 400 of FIG. 4 is depicted in the flowchart 460 of FIG. 6. The flowchart 460 is also based on the presence of a bypass media tray (124, FIG. 1), and addresses the situation where the printing device 100 is connected to a computer 200 (FIG. 2), and a print-job is pending which is to be printed on custom media from the bypass tray. It is further assumed that the custom print-job will only be printed when the user prompts the printing device 100, via the primary user interface button 120, to begin printing. (This configuration allows a user to place the proper custom media in the bypass tray at leisure.) Accordingly, from step 402 of FIG. 4, once it has been determined that a "button engaged" input signal has been received by the processor (132, FIG. 1), then at step 462 (FIG. 6) a determination is made whether or not a print-job requiring special media (i.e., media from the bypass tray 124, FIG. 1) is pending. If not, then control proceeds with step 404 of FIG. 4. However, if a special print-job is determined to be pending, then at step 464 (FIG. 6) a determination is made whether or not sheet media has been placed in the bypass tray 124 (FIG. 1). This can be accomplished using the bypass media detector 118, for example. If at step 464 (FIG. 6) media is detected in the bypass tray 124 (FIG. 1), then at step 468 (FIG. 6) the print-job is printed on the media in the bypass tray, and control returns to step 402 (FIG. 4). However, if at step 464 (FIG. 6) media is not detected in the bypass tray 124 (FIG. 1), then at step 470 (FIG. 6) the processor (132, FIG. 1) prompts the user to insert media in the bypass tray or, alternately, to cancel the pending print-job. This can be accomplished by the processor 132 (FIG. 2) signaling the printer driver program (208, FIG. 2) to display a message on the display screen 220. The print-job can be cancelled, for example, by using printer control interface software (as an applications program 210). Returning to FIG. 6, once the user has been prompted at step 470, then at step 472 a determination is made whether the user has responded to the prompt by canceling the print-job. If the print-job has been cancelled, then control returns to step 402 (FIG. 4). However, if at step 472 it is determined that the print-job has not been cancelled, then control returns to step 464 to determine whether media has been placed in the bypass tray (124, FIG. 1). This cycle (steps 464 through 472, FIG. 6) continues until the user either cancels the print-job or places media in the bypass tray 124 (FIG. 1).

Yet another embodiment of the present invention provides for a method of controlling a printing device (e.g., printing device 100 of FIGS. 1 and 2) which includes a primary user interface button (e.g., button 120), and which is connectable to a computer (e.g., computer 200 of FIG. 2). The method includes determining generation of an input signal resulting from actuation of the primary user interface button in an intended manner (e.g., a single pulsed actuation), and determining whether or not the printing device is connected to the computer. In response to determining generation of the input signal and determining that the printing device is not connected to the computer, a demonstration page (e.g., demo-page "DP" of FIG. 1) is printed. However, in response to determining generation of the input signal and determining that the printing device is connected to the computer, a function defined within the computer is performed. The function can be defined within the printer driver routine (208, FIG. 2) and can include such functions as, for example, printing a configuration report (configuration page "CP" of FIG. 2), performing a fuser cleaning operating within the printing device 100, or even printing a demonstration page.

In one variation of the method, the input signal produced by actuating the primary user interface button 120 in the intended manner produces a first type of input signal ("first input signal"), and the function defined within the computer 200 (FIG. 2) is a first function. The method can then further include determining generation of a second input signal resulting from actuation of the primary user interface button 120 in a secondary manner (as for example, a press-and-hold actuation, or a two-pulse actuation). In response to determining generation of the second input signal, the method can include performing a second function. The second function can either be defined within the printing device 100 (as for example, in the user interface routine 140), or it can be defined within a connected computer (for example, it can be defined in the printer driver routine 208 depicted in FIG. 2). The second function can be different than the first function defined within the computer, or it can be the same. Further, the second function can also include printing a demonstration page. The chart 500 of FIG. 7 provides examples in rows 510 and 512 of secondary types of actuation of the primary user interface button 120 (FIG. 1), and the types of functions that can be performed by the printing device 100 (FIGS. 1 and 2) depending on the connectedness or non-connectedness of the printing device 100 to a computer.

When the printing device (100, FIG. 2) is determined to be connected to the computer (200, FIG. 2), the method can further include determining whether the computer is transmitting a print-job to the printing device, and canceling the print-job in response to determining generation of the input signal, determining that the computer is connected to the printing device, and determining that a print-job is being transmitted to the printing device.

We claim:

1. A printing device which is connectable to a computer, comprising:

a user interface which includes a primary user interface button, and wherein:

when the printing device is not connected to the computer and the primary user interface button is actuated in an intended manner, the printing device prints a demonstration page; and when the printing device is connected to the computer the printing device is configured to detect the presence of the computer, and to perform a function defined within the computer when the primary user interface button is actuated in the intended manner.

2. The printing device of claim 1, and further comprising:

a processor in signal communication with the primary user interface button; and a computer readable memory device which is readable by the processor, and wherein the computer readable memory device contains therein a digital representation of the demonstration page.

3. The printing device of claim 2, and wherein the computer readable memory device contains therein a user interface routine which is executable by the processor to check for a connection to the computer, to cause the printing device to print the demonstration page when the printing device is determined to not be connected to the computer, and to perform the function defined within the computer when the printing device is determined to be connected to the computer and the primary user interface button is actuated in the intended manner.

4. The printing device of claim 1, and wherein the primary user interface button is the only button in the user interface.

5. The printing device of claim 1, and wherein the intended manner of actuation of the primary user interface button is a single pulsed actuation.

6. The printing device of claim 1, and wherein the function defined within the computer comprises printing a configuration report.

7. A printing system, comprising:

a computer comprising a computer processor, a computer memory device, and a printer driver program stored in the computer memory device and executable by the computer processor;

a printing device in signal communication with the computer processor, the printing device comprising a user interface which includes a primary user interface button, and wherein:

when the printing device is not connected to the computer and the primary user interface button is actuated in an intended manner, the printing device prints a demonstration page; and when the printing device is connected to the computer the printing device is configured to detect the presence of the computer, and to perform a function defined by the printer driver program when the primary user interface button is actuated in the intended manner.

8. The printing system of claim 7, and wherein the function defined by the printer driver program comprises causing the printing device to print a configuration report.

9. The printing system of claim 7, and wherein the printer driver program is configurable to allow the function defined by the printer driver program to be selectable.

10. The printing system of claim 9, and wherein the function defined by the printer driver program is selectable between causing the printing device to print the demonstration page, and performing an operation other than printing the demonstration page.

11. The printing system of claim 7, and wherein the printing device further comprises:

a printer processor in signal communication with the primary user interface button; and a printer memory device which is readable by the printer processor, and wherein the printer memory device contains therein a digital representation of the demonstration page.

12. The printing system of claim 11, and wherein the printer memory device contains therein a user interface routine which is executable by the printer processor to check for a connection to the computer, to cause the printing device to print the demonstration page when the printing device is determined to not be connected to the computer, and to perform the function defined by the printer driver when the printing device is determined to be connected to the computer and the primary user interface button is actuated in the intended manner.

13. A control system to control a printing device, the printing device including a primary user interface button, the control system comprising:

a processor configured to receive an input signal from the primary user interface button resulting from actuation of the primary user interface button in an intended manner;

a memory device which is readable by the processor, the memory device containing therein a set of computer executable instructions which can be executed by the processor, the set of computer executable instructions configured to:

determine receipt of the input signal by the processor;

determine whether or not the printing device is connected to a computer;

cause the printing device to print a demonstration page in response to determining that the printing device is not connected to the computer and that the input signal is received by the processor; and cause the printing device to perform a function defined within the computer in response to determining that the printing device is connected to the computer and that the input signal is received by the processor.

14. The control system of claim 13, and wherein the printing device is configured to receive data from the computer in the way of a print-job, and the set of computer executable instructions are further configured to:

determine whether the printing device is receiving data from the computer in the way of the print-job; and cancel the print-job in response to determining that the input signal is received by the processor.

15. A method of controlling a printing device which is connectable to a computer, the printing device including a primary user interface button, the method comprising:

determining generation of an input signal resulting from actuation of the primary user interface button in an intended manner;

determining whether or not the printing device is connected to the computer;

printing a demonstration page in response to determining generation of the input signal and determining that the printing device is not connected to the computer; and performing a function defined within the computer in response to determining generation of the input signal and determining that the printing device is connected to the computer.

16. The method of claim 15, and wherein the function defined within the computer comprises printing a configuration report.

17. The method of claim 15, and further comprising:

when the printing device is determined to be connected to the computer, determining whether the computer is transmitting a print-job to the printing device; and canceling the print-job in response to determining generation of the input signal and determining that the print-job is being transmitted to the printing device.

* * * * *

UNITED STATES PATENT AND TRADEMARK OFFICE

CERTIFICATE OF CORRECTION

PATENT NO. : 6,761,493 B1
DATED : July 13, 2004
INVENTOR(S) : Howard G. Hooper, III et al.

It is certified that error appears in the above-identified patent and that said Letters Patent is hereby corrected as shown below:

Title page,
Item [75], Inventors, delete "Howard G. Hooper" and insert therefor -- Howard G. Hopper, III --.

Signed and Sealed this

Twenty-third Day of August, 2005

JON W. DUDAS
*Director of the United States Patent and Trademark Office*